US007779931B2

(12) United States Patent
Townsan

(10) Patent No.: US 7,779,931 B2
(45) **Date of Patent: *Aug. 24, 2010**

(54) ELECTRIC HAND SCREWDRIVER WITH ADJUSTABLE HEAD

(76) Inventor: Joel Townsan, 80-2 Upper Bluffs Dr., Port Townsend, WA (US) 98368-2560

( * ) Notice: Subject to any disclaimer, the term of this patent is extended or adjusted under 35 U.S.C. 154(b) by 56 days.

This patent is subject to a terminal disclaimer.

(21) Appl. No.: 11/938,653

(22) Filed: Nov. 12, 2007

(65) Prior Publication Data

US 2008/0289843 A1 Nov. 27, 2008

Related U.S. Application Data

(60) Provisional application No. 60/865,225, filed on Nov. 10, 2006.

(51) Int. Cl.
*E21B 19/081* (2006.01)

(52) U.S. Cl. ..... 173/216; 173/217; 81/57.26

(58) Field of Classification Search ..... 173/216, 173/217; 81/57.26
See application file for complete search history.

(56) References Cited

U.S. PATENT DOCUMENTS

| | | | | |
|---|---|---|---|---|
| 1,970,369 | A | 8/1934 | Focht | |
| 2,348,266 | A | 5/1944 | Selby | |
| 2,414,637 | A | 1/1947 | Crump | |
| 4,748,872 | A * | 6/1988 | Brown | 81/57.26 |
| 4,970,918 | A | 11/1990 | Brewer et al. | |
| 5,251,706 | A | 10/1993 | Evans | |
| 5,372,420 | A | 12/1994 | Van Deursen et al. | |
| 5,533,581 | A | 7/1996 | Barth et al. | |
| 5,784,934 | A | 7/1998 | Izumisawa | |
| 6,050,989 | A * | 4/2000 | Fox et al. | 606/1 |
| D436,819 | S | 1/2001 | Liu | |
| 6,168,287 | B1 | 1/2001 | Liu | |
| 6,293,172 | B1 | 9/2001 | Smith | |
| 6,435,060 | B1 * | 8/2002 | Izumisawa | 81/57.39 |
| 6,796,385 | B1 | 9/2004 | Cobzaru et al. | |
| 6,928,902 | B1 * | 8/2005 | Eyssallenne | 81/57.26 |
| 7,024,966 | B2 * | 4/2006 | Chao | 81/57.26 |
| 7,156,187 | B1 * | 1/2007 | Townsan | 173/1 |
| 7,191,677 | B2 * | 3/2007 | Barkdoll | 74/396 |
| 7,207,233 | B2 * | 4/2007 | Wadge | 74/412 R |
| 2007/0144310 | A1 * | 6/2007 | Pozgay et al. | 81/57.26 |
| 2009/0031865 | A1 * | 2/2009 | Alberti et al. | 81/57.11 |

* cited by examiner

*Primary Examiner*—Brian D Nash
(74) *Attorney, Agent, or Firm*—Jellett Law PS

(57) ABSTRACT

An apparatus to accomplish rotational work on a securing element. The apparatus has a main body portion and an articulating arm. The main body has a power source, a drive motor, and a drive shaft. The drive shaft extends into the articulating arm which has a first section rotatable about the drive shaft. The articulating arm also has a second section which is seated on a first transversely aligned drive shaft interoperating with the drive shaft itself. The first transversely aligned drive shaft transmits rotational work to a second transversely aligned drive shaft which supports a third section. A third section interoperates with a spindle section which receives the rotational work from the second transversely aligned drive shaft to accomplish rotational work on the securing element.

28 Claims, 13 Drawing Sheets

(30 DEG.)

(45 DEG.)

(75 DEG.)

(90 DEG.)

(105 DEG.)

ELECTRIC HAND SCREWDRIVER WITH ADJUSTABLE HEAD

RELATED APPLICATIONS

This application claims the benefit and incorporates by reference previously filed provisional patent application Ser. No. 60/865,225 filed Nov. 10, 2006 which was and commonly assigned with previously filed utility patent application U.S. Ser. No. 11/129,180 filed May 13, 2005.

BACKGROUND

U.S. Pat. No. 1,970,369 discloses a coal drilling apparatus in Col.1 line 33, a truck frame is mounted to an axel system and these are fitted with wheels that are adapted to rest upon and travel on rails. Further down at line 40, the mechanism has an electric motor connectable to a gearing with a chain and axles which actually change. The drilling mechanism is mounted upon a turntable carried by the truck frame. On the turntable is a motor which actuates the drilling mechanism. The motor is electric. A shaft is connected to the motor through the spur gears and the shaft has an arm with a locking member adapted to engage suitable apertures within the annular flange of the rim of the frame. By locking the member, the arm may be held in a preferred position of angular adjustment about the shaft.

U.S. Pat. No. 2,414,637 discloses a universal drill support. This device relates to machine or hand tools and a drill adapted for universal movement. The tool is adapted for universal swivel movement and a full 360° in 2 directions at right angles to each other. Referring to Col.1 at line 27, a universal drill has an elongated handle member with a bore extending the length of the handle. The bore receives the bearing for a shaft on which a thrust collar is positioned and secured by a pin.

U.S. Pat. No. 5,533,581, discloses an electric hand tool, in particular a drill with a housing, an electric motor, a motor shaft parallel to the housing axis, a work spindle driven by the electric motor, work spindle driven by transmission gearing, the housing divided along a dividing plane for the purpose of switching from straight drilling to angular drilling. The drill spindle as referred to in Col.4 at line 3 is rotatably supported in a bearing of the housing and projects out of the housing. The drill spindle carries a drill chuck at its free and protecting out the housing for clamping a drill bit. Housing is divided along a dividing plane, into a front housing part for the drill spindle and a rear housing part containing the motor and the motor shaft. The dividing plane is situated at an angle of 45° relative to the axis of the motor shaft. The transmission gearing further down in Col.4 at line 33, between the motor shaft and the spindle extends parallel to the motor shaft, but offset relative to the motor shaft.

U.S. Pat. No. 6,796,385 discloses a fastener driving machine and associated method. The machine is advantageously structured to provide a substantially constant level of torque to a delivery point on the head of the machine independent of the position of the head with respect to the driver. The machine is referred to in Col.2 outline 57, has a driver structured to provide a given level of torque and also includes a transmission apparatus. The transmission has a gear mechanism, a support, an index, a head, and a structure to transmit the mechanical effort between the driver and the head. The index apparatus that is a first portion in the second portion with the first and second portions biased towards one another. With regard to adjusting the head to various conditions and configurations, referring to Col.11 outline 17, to adjust the head and therefore move the delivery point in one position to another the lock rings unthreaded from the first teeth. The indexing housing and support are pulled apart to disengage the first and second teeth and the indexing housing is rotated with respect to the support until the desired position is achieved.

U.S. Pat. No. 2,348,266 discloses an angle tool holder for angle drills. An attachment is provided which can be easily connected to the usual spindle or chuck of a cutting or drilling machine, for instance the chuck of a portable drill. In Col.2 at line 6, the casing has two complementary hollow sections. There is an upper hollow section and a lower hollow section, which face each other and are arranged around a vertically aligned bolt. Thus the upper or lower sections can be adjusted relative to one another in the radial direction around the bolt, the bolt being tightened and loosened to allow fixation or adjustment of the sections. Further, at line 53 Col.2, the upper section has a shank extending outward so the ringed right angle from the bolts. The end of the upper shank extends outside of the shank and can be engaged with the spindle or tool holder. The end of the lower shank extends outside of the lower casing and can hold the tool. Rotation is provided from the upper shank through a gear transmission and into the transmission arranged around the vertical bolt. The rotation is then transmitted into a gear transmission which is connected to the lower shank. When the upper shank is rotated, and referring to Col.3 at line 19, transmits rotation through the double gears of the transmission to the lower shank and rotates to the tool bit.

U.S. Pat. No. 5,372,420 discloses a device having a rotatable head with a housing having a first and second housing member. First housing member is rotatable relative to the second housing member between the first and second operating positions. The longitudinal axis of the first housing member is disposed substantially 90° relative to the longitudinal axis of the second housing member when in the first operating position. The longitudinal axis of first housing member is disposed coaxial with the longitudinal axis the second housing member when in the second operating position. A locking arm engages in the first housing member for retaining the member in the desired positions.

U.S. Pat. No. 6,168,287 discloses a combination of an electric power tool and an illuminating device received in the tool. Power tool has a handle for receiving batteries and a barrel with a drive shaft rotatably connected to the end of the barrel portion. The drive shaft is controlled by a switch which is electronically connected to the batteries of the drive shaft. An illuminating device includes two light bulbs attached to the drive shaft and being electronically connected to the switch so that by turning on the switch the bulbs illuminate. Further in Col.2 at line 11, the electric power tool has a handle, a barrel, batteries within the barrel, with a cap on the lower end of the barrel to contain the batteries, a drive shaft from the barrel portion, a switch connected to the barrel portion, the switch electronically connected to the drive shaft and the batteries, the drive shaft actuated by the switch and the batteries, the illuminating device having two bulbs and electrically connected to the switch.

USD 436,819 discloses an electronic screwdriver, which is a designed for the casing of an electronic screwdriver which seems to be in the shape of a portable electronic drill. The ornamental design shows a lower handgrip arranged in the vertical direction and an upper cylindrical shaped head casing arranged in the longitudinal direction with what seems to be a screw driver bit adjustable holder mechanism at the head of the casing.

U.S. Pat. No. 5,784,934 discloses a ratchet wrench with pivotal head. The ratchet wrench has a handle for gripping and a head having a ratchet mechanism including a drive shaft capable of powered rotation about its axis. The head and handle have openings in registration with one another and a pin is received through the openings interconnecting the handle and head, which permits pivoting movement of the handle and head relative to one another about a longitudinal axis of the pin to any multiplicity of selected angular orientations. The ratchet wrench includes a transmission constructed to transmit power from the motor to the ratchet mechanism through the pin interconnection of the handle and head.

U.S. Pat. No. 5,251,706 discloses a ratchet drive tool with manual and non-manual power actuation where the power source is supplied by a battery, or an electrical or pneumatic supply. A drive shaft extends coaxially from the housing which contains speed reducing/power amplifying structures and the drive shaft is connected to the head of the device through a pivot joint assembly.

U.S. Pat. No. 6,293,172 discloses a telescopic pocket door angle drill which has a right angle driver with a telescopic handle portion which can be extended to reach into confined spaces. The right angle driver has a casing and an internal gear assembly for translating rotary motion from horizontal drive to a vertical drive.

U.S. Pat. No. 4,970,918 discloses an adjustable tool for manipulating a fastening device such as a bolt or screw. The tool has a handle which is rotatable about a shaft, the shaft being inserted through the handle. A housing pivots about one end of the handle and has an end which can be rotated to manipulate a fastening device at angles of 0 degrees, 90 degrees, and 270 degrees from the drive shaft.

DESCRIPTION OF THE PREFERRED EMBODIMENTS

This present concept relates to an electric hand tool, particularly portable electric screwdrivers. In general, portable electric screwdrivers come in two general categories. The first category is specifically designed to replicate or act more as a portable electric hand drill. These hand drills are configured in the general shape of a handgun having a lower handle section running essentially vertically, with a transverse body section where the motor is housed in the drive shaft which turns the spindle. The spindle head has a chuck which holds either the drill bit or the screwdriver bit. Generally, the power source is contained within the handle portion and provides for enough space to store a large battery with significant amounts of power to run the drill for long periods of time. The spindle chuck is generally fixed in one direction or location offering limited range of movement.

The second category of portable electric screwdriver is one that is generally designed to replicate a handheld screwdriver. The housing on these portable handheld devices is generally cylindrical and has a power source in the handle section which is limited in size to the housing thus providing for a small battery with less amount of power to run for a limited period of time. The motor is also contained within the housing and drives a drive shaft which is connected to the screwdriver bit spindle section. In either case, users commonly encounter situations where they need to access small spaces such as car doors, home appliances and the like, where the use of a portable electric hand screwdriver with a spindle head which can pivot throughout a large range of angular positions within the small space, would be very beneficial to completing their respective tasks.

Figure 1:
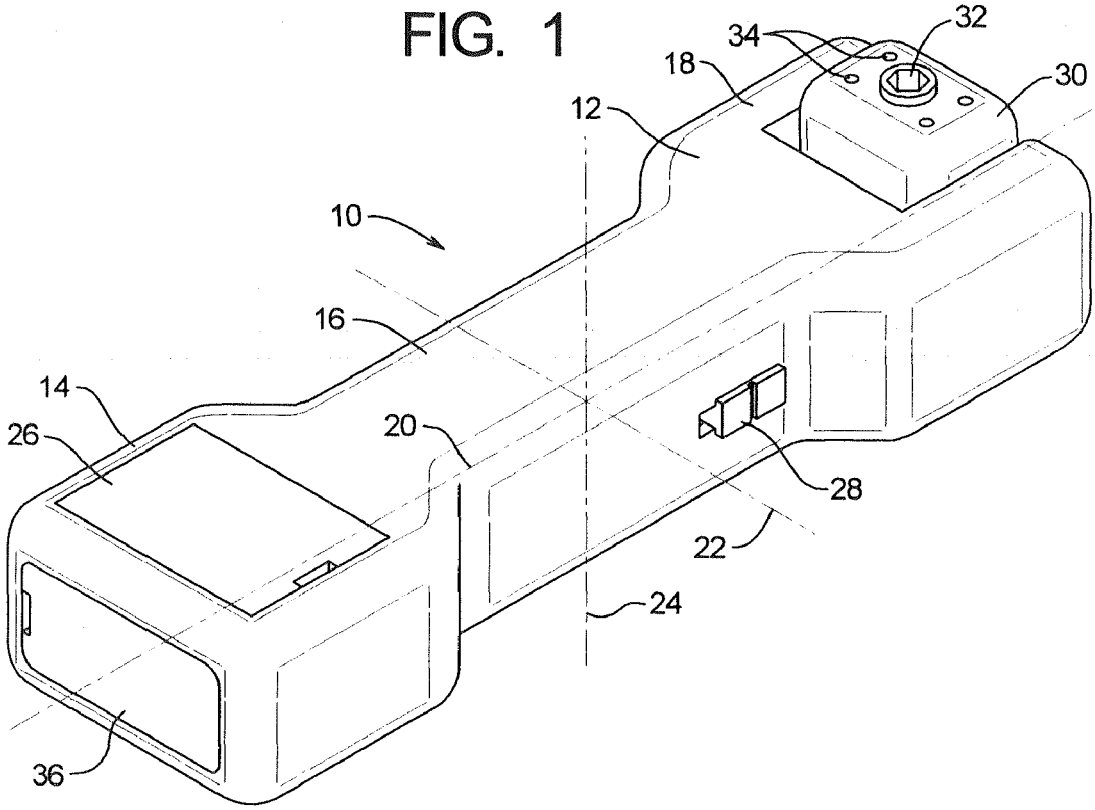
FIG. 1 is a perspective view of the handheld electric screwdriver.

With the foregoing in mind and in light of the existing prior art, referring to FIG. 1, a portable electric handheld screwdriver 10 is shown. In the current embodiment, the portable electric handheld screwdriver 10 has a housing 12 having a lower end 14, a middle handle section 16, and an upper head section 18. The middle handle section is narrower than the lower end 14 and the upper end 18, to provide for ease of gripping for individuals with smaller hand sizes.

In order to provide power to the motor of the electric hand screwdriver, a removable rechargeable battery is provided in the housing at the low end 14 of the housing. In order to provide for a significant useful life for the hand screwdriver 10, the lower end 14 of the housing has been enlarged to receive a rechargeable battery pack 40 of reasonable size and capacity.

The housing 12 is arranged along a longitudinal axis 20, a transverse axis 22, and a vertical axis 24. Referring now to both FIGS. 1 and 2, in the current embodiment, the lower end 14 of the housing has encased within it a removable rechargeable battery 40, which can be removed through a battery hatch 36 connected on to the bottom face of the housing 12.

Many times, a user will need to utilize more than one type of screwdriver head on the project. Thus, included on the outside face of the housing lower end 14 is a bit holder compartment 26 which is configured to hold the screwdriver head bits when not in use. For example, screwdriver bits could be configured for various Phillips head sizes, as well as Flathead sizes to provide the user with an easy assortment of drill bits or screwdriver bits for use during their project.

The portable electric handheld screwdriver 10 is turned on and off by the power button 28 located on the side face of the housing middle section 16. Positioning the power button 28 at this upper side face location enables a user to engage the power button with his or her thumb.

While the power button 28 is located on the side and has an on/off switch, a variable current trigger device can be utilized as well as other embodiments, not shown but easily conceived.

As previously discussed in the background section, many portable electric screwdrivers have a drill chuck and bit holder which is either fixed in a specific location relative to drive shaft, or is so large that movement of the drill chuck to various angular positions will not provide for ease of use of the portable screwdriver within a relatively small space configuration. To alleviate these problems, protruding out of the upper housing portion 18, is a spindle housing 30 which holds a series of LED lights 34 as well as the magnetic spindle shaft 32 which holds the screwdriver bits discussed previously. The spindle housing can rotate 210° around the transverse axis and along the vertical and longitudinal plane. As will be discussed below, the magnetic spindle shaft 32 is designed to keep a relatively small profile, meaning that it will not extend in the vertical direction very far past the housing limits.

To provide for an efficient use of space within the housing, as well as the efficient transfer of power from the battery pack, to the motor, to the drive shaft and then to the spindle, the main components of the handheld electric screwdriver 10 are positioned along the longitudinal axis.

Figure 2:
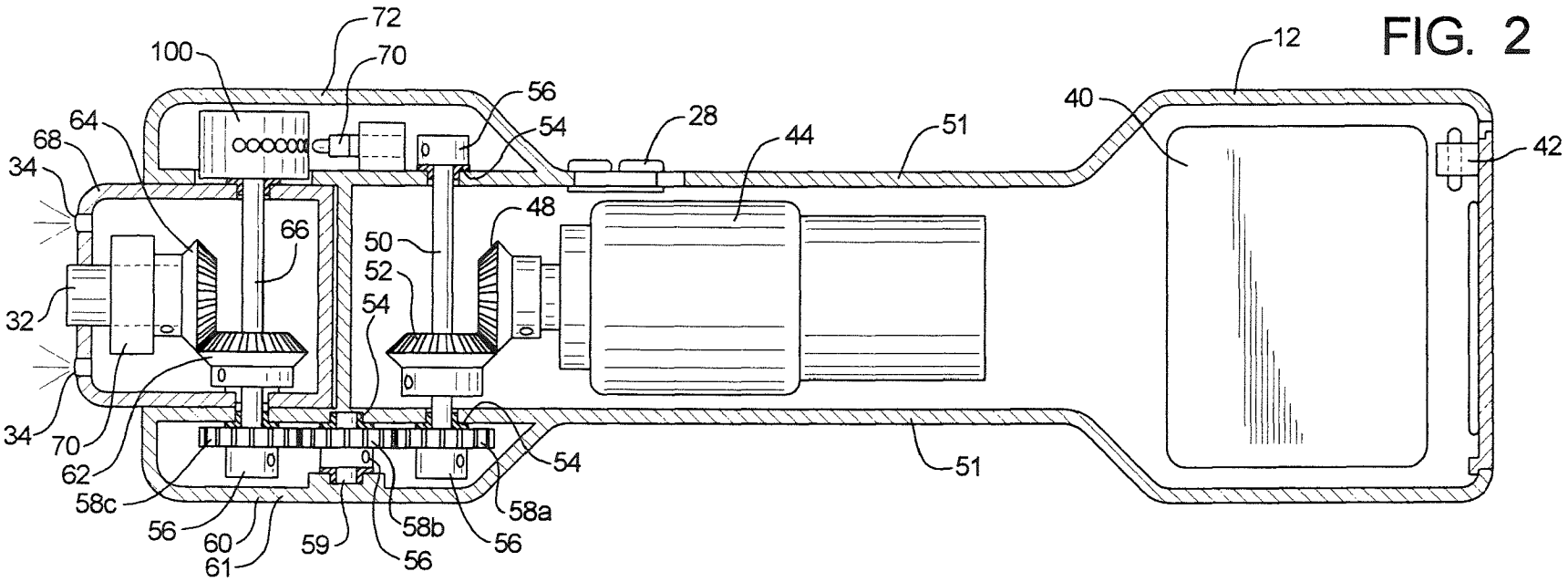
FIG. 2 is a plan view of the handheld electric screwdriver.

Still referring to FIG. 2, and discussing the inner workings of the portable electric handheld screwdriver 10, the rechargeable battery 40 is connected to a motor with gearbox 44, the motor 44 driving a drive shaft 46 which in turn is connected to a drive shaft gear 48. The gear 48 can be any gearing mechanism which transfers rotation from a drive shaft axis to another non-parallel axis, such gear being a miter gear, bevel gear or other mechanism known in the art. The drive shaft of the motor 46 is positioned in parallel with the longitudinal direction of the housing 12.

In general, handheld screwdrivers have been provided where the spindle or bit holder section can pivot rotationally perpendicular to the shaft of the screwdriver. The pivoting angular distance is naturally limited by the interference of the shaft. Taking for example a typical handheld ratchet or screwdriver having a pivoting head, the head might start parallel to the screwdriver shaft at a zero degree position. Rotating either positive or negatively, the head might rotate to a 90 degree negative rotation position. The user may then wished to rotate the head position further, but may be limited in rotating to 90° by the actual physical interference of the screwdriver shaft and the thickness of the screwdriver head. At best, the user might be able to obtain a 60° rotation.

To provide for an additional range of rotation of the spindle head 30, instead of extending longitudinally forward and connecting with the magnetic spindle shaft and bit holder, the drive shaft 46 terminates immediately after exiting the motor 44.

The drive shaft miter or bevel gear 48 provides for interoperability with a first transverse shaft miter or head gear 52. In order to be positioned for interoperability, the transverse miter or bevel gear 52 is positioned on a lower transverse drive shaft 50. The lower transverse drive shaft 50 is supported by the housing sidewalls 51. Embedded within the housing sidewalls 51 are ball bearings 54 which allow the transverse drive shaft 50 to rotate freely about the transverse axis. To fix the shaft into position, shaft collars 56 are provided at the ends of the transverse drive shaft 50 so that the drive shaft 50 and transverse shaft miter gear 52 or similar, to stay in their proper position relative to the transmission.

Still referring to FIG. 2, to transfer the drive power ultimately to the magnetic spindle shaft 32, a series of off-center, longitudinally aligned spur gears 58 or similar, are provided outside of the main housing area in an off-center spur gear casing 60 is configured on the side of the main housing to encompass the spur gears 58. The lower transverse drive shaft 50 extends through the main housing sidewall's 51 and into the spur gear casing 60. A first longitudinally lower positioned spur gear 58A is connected to the lower transverse drive shaft 50. Lower transverse drive shaft 50 extends through this spur gear 58A and terminates in the casing 60. Attached to the end of the drive shaft is a shaft collar 56. Positioned longitudinally forward of the first spur gear 58A is an intermediate spur gear 58B. This intermediate spur gear 58B is positioned on an intermediate gear shaft 59 which is supported by the outside wall 61 of the spur gear casing and the main housing sidewall 51. This intermediate transverse spur gear shaft 59 sits in ball bearings 54 housed to the casing walls. Operatively connected to the intermediate longitudinally aligned spur gear 58B, is a forward positioned spur gear 58C.

This forwardly positioned spur gear 58C is connected to an upper transverse drive shaft 66. The upper transverse drive shaft 66 is longitudinally positioned away from the lower transverse drive shaft 50 to provide for the desired rotational freedom for the spindle housing 68.

The upper transversely aligned drive shaft 66 performs a number of various functions. First, the drive shaft is powered by the forwardly positioned spur gear 58C and is rotated about the transverse axis, thus rotating a connected upper transverse shaft miter or bevel gear 62. The miter gear 62 in this case, is connected operatively to an upper spindle miter gear which is orientated perpendicular to the upper transverse shaft miter gear 62. Thus, power from the transmission can be transferred from the upper transverse drive shaft 66 to drive the magnetic spindle shaft 32 which is operatively connected to the upper spindle miter gear 64. Secondly, the spindle housing utilizes the upper transverse drive shaft 66 as an axle to rotate throughout various angular positions around the center axis of the axle or upper transverse drive shaft 66. The drive shaft 66 is supported by the housing sidewalls 51, and the spindle housing 68, operates on the drive shaft 66 by rotating on ball bearing casings 54 mounted on the drive shaft 66 to allow the spinal housing 68 to move independently of the drive shaft 66.

Figure 3:
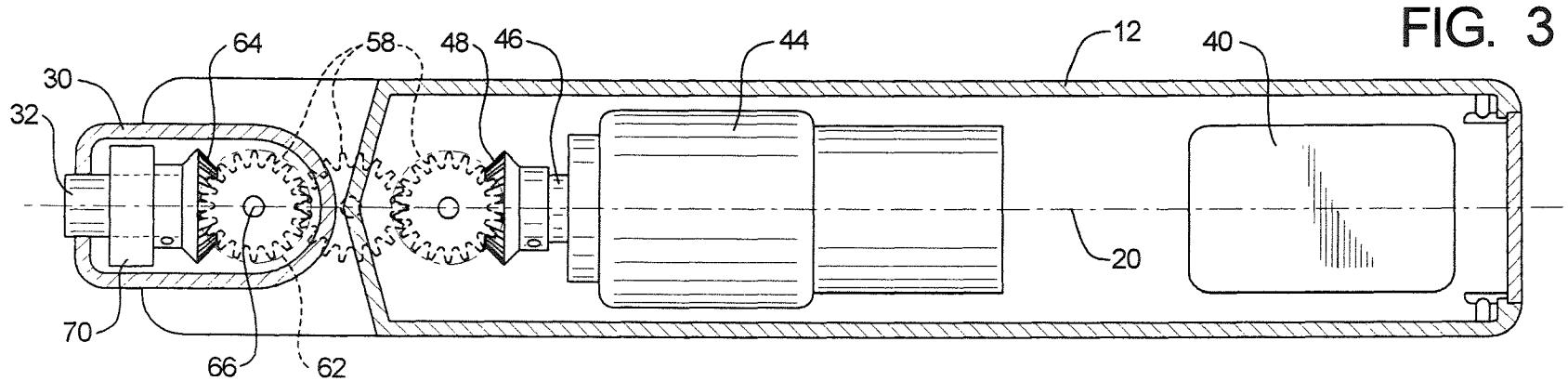
FIG. 3 is an elevation view of the handheld electric screwdriver.
Figure 3A:
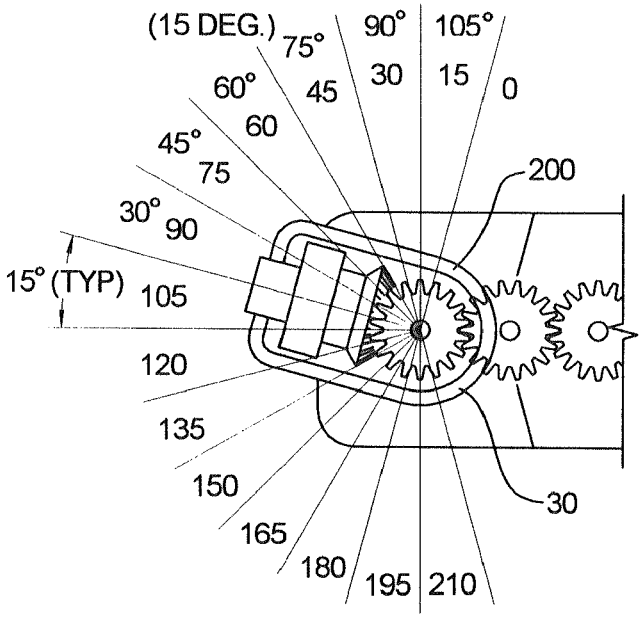
FIG. 3A is a detailed view of the spindle head rotated to a positive 15 degree position.

Referring now to both FIGS. 2 and 3, as stated previously, the majority of existing powered portable electric screwdrivers 10 have the spindle housing 30 fixed in a stationary position along the longitudinal axis 20 parallel or directly on center with the drive shaft 46. In the current embodiment, the spindle housing 30 has been disconnected from the drive shaft 46 and has been configured to allow varying degrees of rotational freedom around the central axis of the upper transverse drive 66.

The rotational degrees of freedom for the spindle housing 30 will now be discussed. Referring to FIG. 3, 3A through 3F, the spindle housing in its unrotated position is generally locked in a zero degree or horizontal position to the longitudinal axis. The user, in the current embodiment, is able to fix the spindle housing 30 in rotational increments of 15°. It is conceivable that other incremental degrees of rotation can be provided for the fixation, including providing a locking mechanism which will allow for 360° of integral rotation, a locking mechanism providing one degree of freedom integral rotation, as well as a locking mechanism providing just 45° of freedom integral rotation.

Figure 3B:
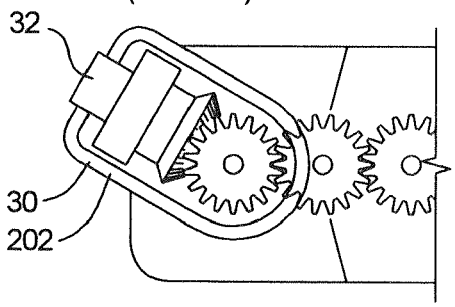
FIG. 3B is a detailed view of the spindle head rotated to a positive 30 degree position.
Figure 3C:
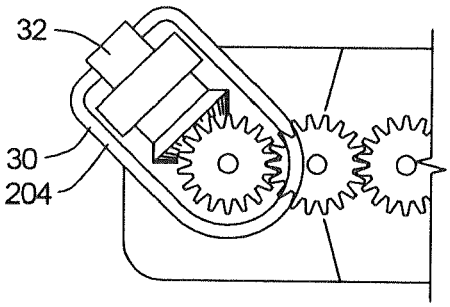
FIG. 3C is a detailed view of the spindle head rotated to a positive 45 degree position.
Figure 3D:
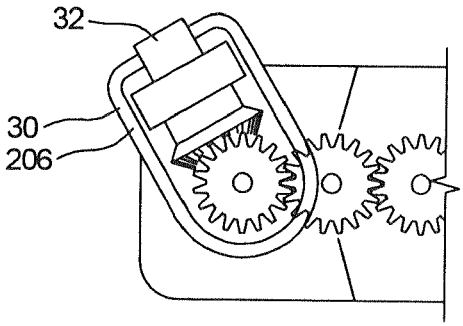
FIG. 3D is a detailed view of the spindle head rotated to a positive 75 degree position.
Figure 3E:
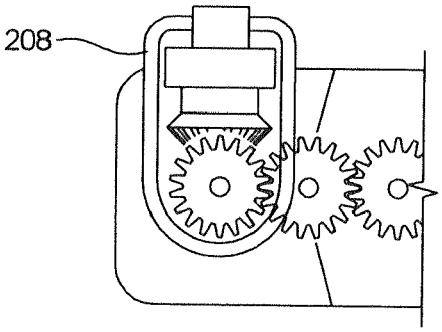
FIG. 3E is a detailed view of the spindle head rotated to a positive 90 degree position.
Figure 3F:
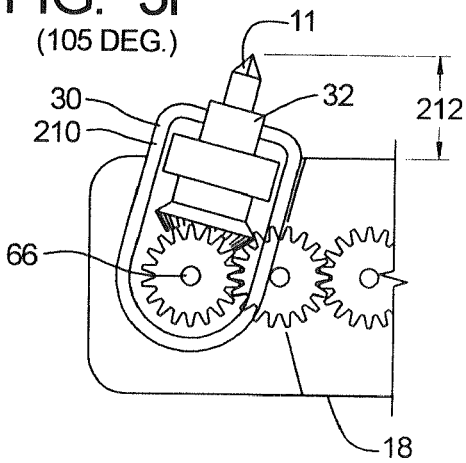
FIG. 3F is a detailed view of the spindle head rotated to a positive 105 degree position.

Referring to FIG. 3, the spindle housing 30 is fixed in a positive 15 degree rotational position 200, and then referring to FIG. 3B, the spindle housing 30 is rotated to a positive 30 degree rotational position 202, still rotating positively, the spindle housing 30, referring to FIG. 3C is positioned at a positive 45 degree rotational position 204. Moving along to a greater positional degree of freedom, the spindle housing 30, in FIG. 3D is positioned at a positive 75 degree rotational position 206, and then rotated in FIG. 3E to a positive rotational position of 90° 208. The user may wish to rotate even further then positive or −90° and position the drill bit 11 at a greater than 90° plane of rotation, thus referring to FIG. 3F, the spindle housing 30 has been rotated to a positive 105 degree rotational position 210. The magnetic spindle shaft 32 during the entire rotational operation has stayed above the main housing 16 to allow the screwdriver bit 11 to operate on the previously mentioned fastener 156, FIG. 1A.

Similarly, the spindle housing 30 can rotate in the negative rotational direction to provide for rotational configuration as the user desires.

In order to provide for the locking of the spindle housing 30 in the various rotational positions around the upper transverse drive shaft 66, a locking mechanism is provided on the opposite end of the upper transverse drive shaft 66 from the drive shaft miter gear 62 and integrated with the spindle housing 30. While the below locking mechanism in the current embodiment enables this locking function, other readily available locking mechanisms in the art are easily incorporated and achieved.

Figure 6:
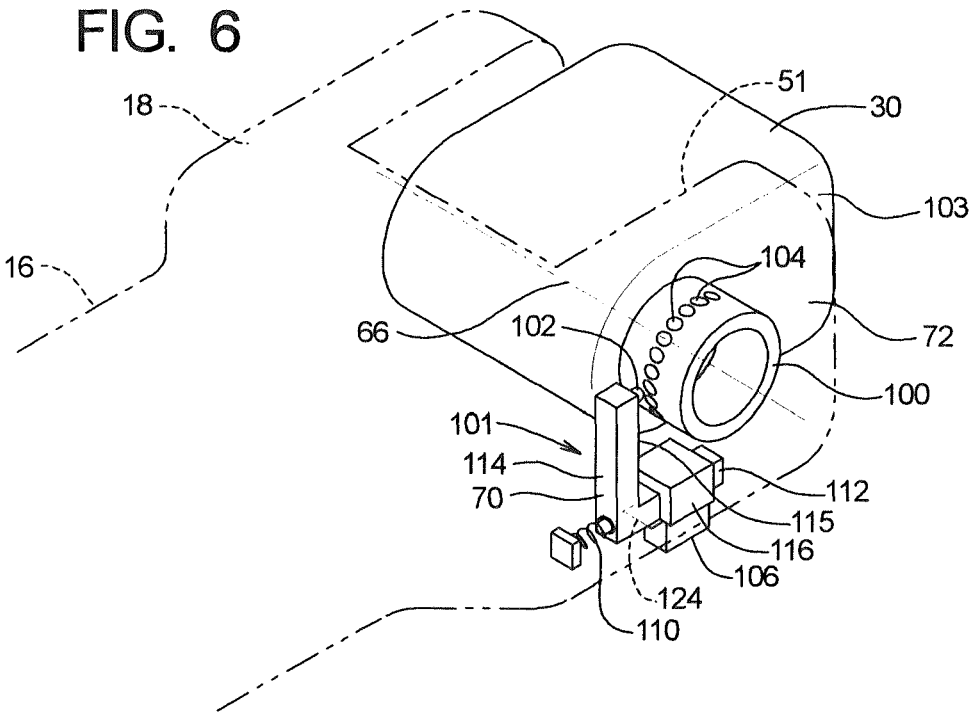
FIG. 6 is a perspective view of the rotational locking mechanism.

Referring first to FIG. 6, the rotational locking mechanism 101 as previously discussed is integrated with the spindle housing 30 as well as the upper main housing 16. The integration of the spindle housing 30 with the rotational locking mechanism 101 is through the use of a female catch lock collar 100. This catch lock collar is a cylinder which extends transversely from the sidewall 103 of the spindle housing 30.

Still referring to FIG. 6, the catch lock collar 100 has, spaced equidistantly around the perimeter of the cylinder, receiving pinholes 104 which correspond to varying angular fixed positions or degrees of freedom which the spindle housing 30 can be rotated throughout and positioned for screwdriver use.

The receiving pinholes 104 correspond to a male pin 102 which is connected to the vertical leg of a male catch lock 70. The vertical catch leg 114 has an upper end and a lower end with the male pin 102 protruding longitudinally forward from the forward surface 115 of the vertical catch lock leg 114.

To provide for smooth longitudinal translation, the male catch lock 70 has a forward longitudinal catch lock leg 112 which slides within a forward longitudinal catch lock sleeve 116.

Also, the current embodiment is designed for the rotational locking mechanism 101 to be positioned outside of the upper main housing 16 to avoid interference with the main transmission. To encompass the entire rotational locking mechanism 101, a catch lock casing 72 is provided which attaches to the outer portion of the housing sidewall 51 and mirrors the geometrical configuration of the spur gear casing 60, as seen in FIG. 2.

A compression spring 110 is provided and positioned at the lower end of the vertical catch lock leg 114. This compression spring, provides a longitudinal compressive force pushing the male catch lock 74 towards the female catch lock collar 100. By providing a compressive force through a spring 110, the male catch lock 70 will not slide out of position from the receiving pinholes 104 and the spindle housing 30 will not rotate out of position during use.

Figure 7:
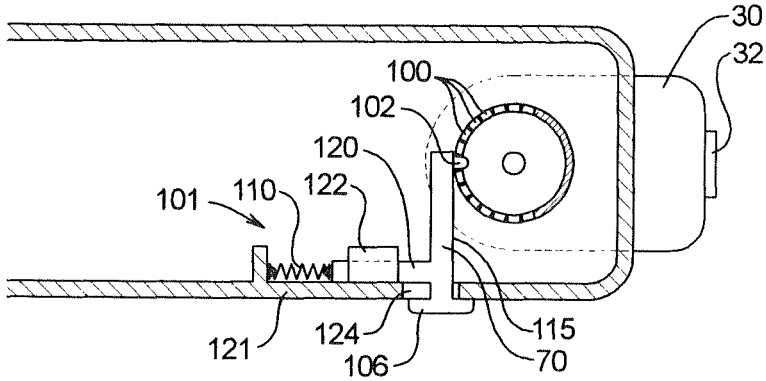
FIG. 7 is an elevation view of an alternative embodiment of the rotational locking mechanism.
Figure 8:
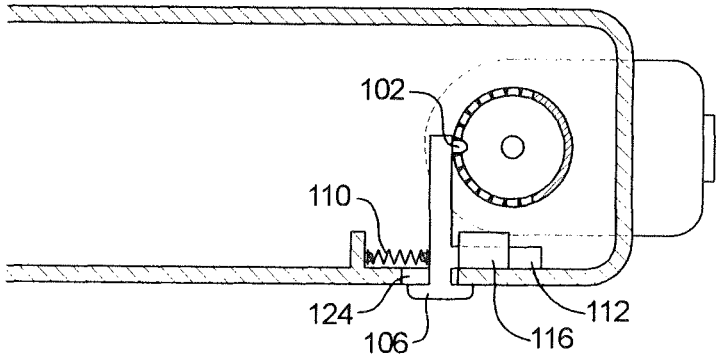
FIG. 8 is an elevation view of the rotational locking mechanism.

Referring to FIGS. 7 and 8, the rotational catch lock mechanism 101 has a button or catch lock actuator 106 which extends vertically downwards from the base of the vertical catch lock leg 114 through a catch lock slot 124 provided at the bottom wall 121 of the catch lock casing 72. In an alternative embodiment, the rearward longitudinal catch lock leg 120 is positioned behind the vertical catch lock leg 114 and connected to the bottom portion of the catch lock leg, and extends through a rearward longitudinal catch locked like sleeve 122 which has positioned behind it the compression spring 110. The catch lock 70 can move a longitudinal direction forward or rearward limited only by the distance of the catch lock slot 124. The catch lock slot 124 is designed to allow the male pin 102 to disengage from the female catch lock collar receiving pinhole 104 so that the user can then rotate the spindle housing 30 to its desired position.

In operation, the user will slide the button 106 backwards and disengage the catch lock pin 102 from the catch lock collar 100. The spring 110 will increase its compressive force, and after the user has rotated the spindle housing 30 to its desired position, the button 106 can be released and the compressive force in the spring 110 pushes the catch lock 70 into the desired pinhole 104 securing the spindle housing 30 in its desired rotational position.

Figure 9:
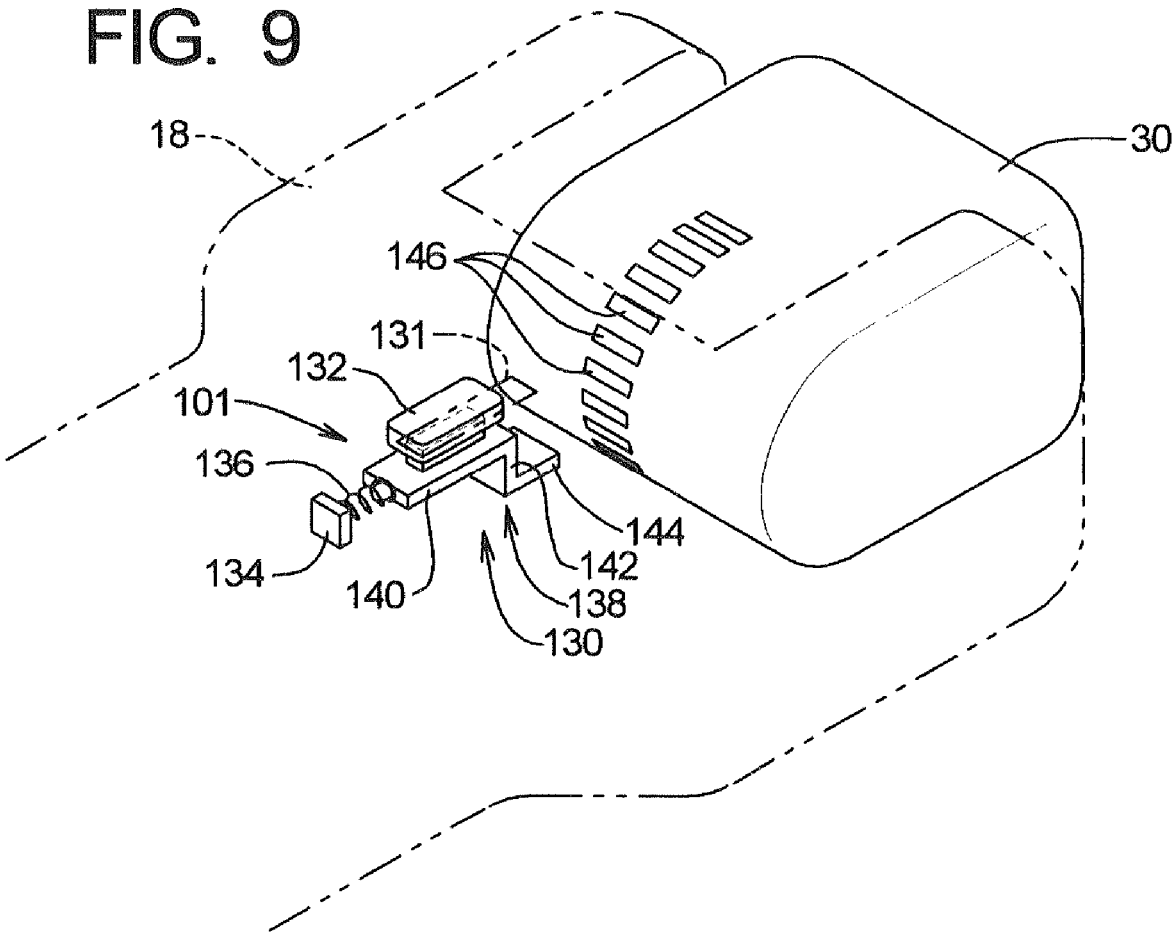
FIG. 9 is a perspective view of an alternative embodiment of the rotational locking mechanism.

In an alternative embodiment, referring to FIG. 9, the rotational locking mechanism 101 is provided in the central portion of the upper housing 18. Here a Z configuration locking leg 138 is provided with a catch lock button 132 extending through a catch lock slot 131 which provides an opening in the upper wall of the main upper housing 18. The button is connected to the upper horizontal leg 140 of the locking leg 138. The upper longitudinal leg 140 has at its back wall a compressive spring 136 which provides the compressive force to security the locking leg 138 into the desired female receiving holes 146 positioned equidistantly along the outer face of the spindle housing 30. The locking leg 138 has a vertical leg portion 142 and a lower longitudinal leg 144. The lower longitudinal leg 144 is provided to lock into the female receiving hole 146 and secure the spindle housing 30 in its desired rotational position.

The lower housing 14 and the middle housing 16 sizes are both dictated by the physical size of the rechargeable battery 40 and the motor 44. Thus, reaching into small confined spaces utilizing a strong motor and powerful rechargeable battery will be difficult if the upper housing vertical height or profile is the same depth as the middle housing 16 and or the lower housing 14.

Figure 1A:
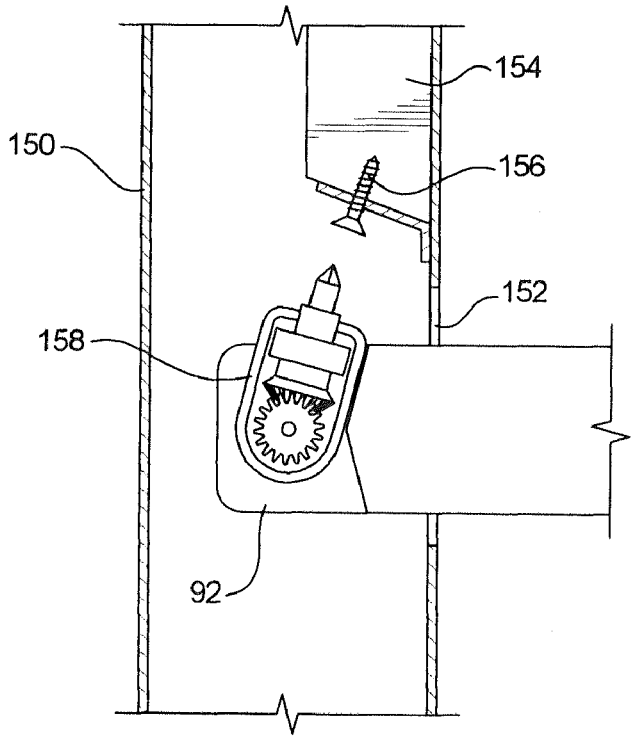
FIG. 1A is a section view of the handheld electric screwdriver inserted into a small working environment.
Figure 4:
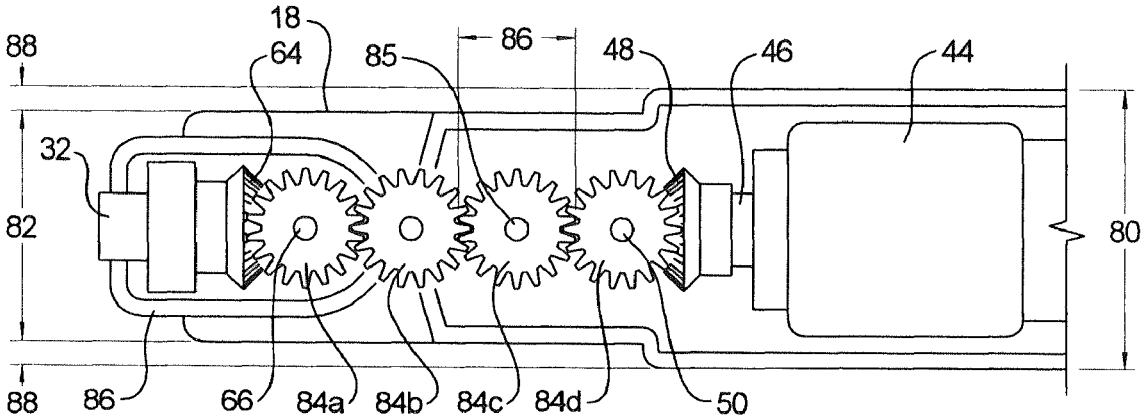
FIG. 4 is an elevation view of the handheld electric screwdriver showing a narrow upper housing height with four smaller diameter longitudinally aligned transmission gears.

Referring to FIG. 4, if the motor 44 is so large that it is restrictive as to accessing smaller spaces, providing a narrower upper housing height 82 can be beneficial for reaching into a confined space such as a car door 150 as seen in FIG. 1A.

In the vertical dimension, the upper housing height 82, FIG. 4, is defined by the diameter 86 of the longitudinally aligned spur gear's 58. Therefore, providing a smaller diameter spur gear 84 and increasing the number of longitudinally positioned spur gear's will narrow the upper housing height 82 but provide the same longitudinal length for the desired reaching capabilities into the smaller spaces.

Still referring to FIG. 4, a plurality of smaller diameter spur gears 84, in this case four spur gears, are shown arranged in the longitudinal direction extending forward into the upper housing 18. Similar to the previous discussion at FIGS. 2 and 3, the longitudinally aligned smaller spur gear's 84 include a first spur gear 84D which is connected to the lower transverse drive shaft 50. This lower transverse drive shaft 50 has a lower transverse miter gear 52 which interfaces with the drive shaft miter gear 48 extending from the motor drive shaft 46. The first small diameter spur gear 84D is connected to a second small diameter spur gear 84C which is positioned on an intermediate spur gear shaft 85. The purpose of the next two spur gears is to provide the transfer of rotational force to the upper transverse drive shaft 66 as previously discussed. The third intermediate small diameter spur gear 84B interfaces with the second spur gear 84C and continues the translation of rotational energy to the upper small diameter spur gear 84A which is connected to the upper transverse drive shaft 66. This upper transverse drive shaft 66 has an upper transverse miter gear 62 which interoperate with an upper spindle miter gear 64 to provide the rotational operation of the magnetic spindle shaft 32 within the smaller spindle housing 86. The operability of the smaller spindle housing 86 to rotate around the upper drive shaft 66 is the same as previously discussed above.

Figure 5:
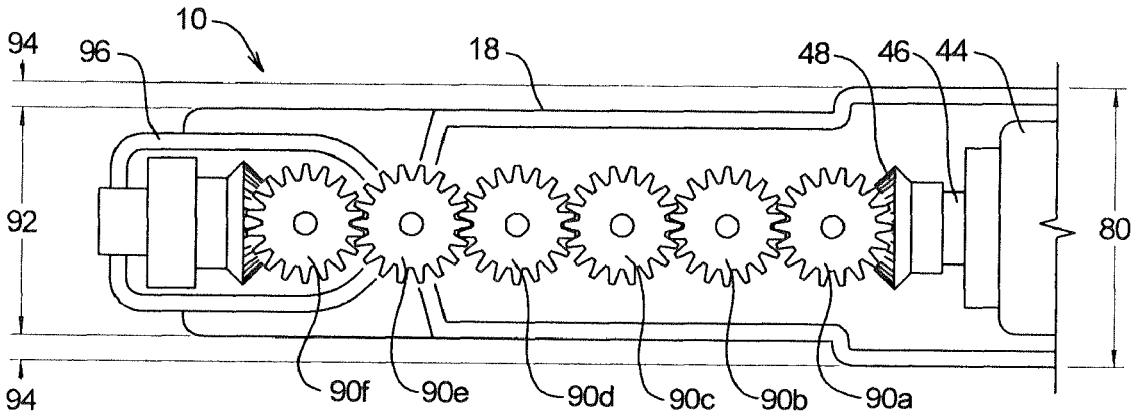
FIG. 5 is an elevation view of the handheld electric screwdriver showing a second narrower upper housing height with six smaller diameter longitudinally aligned transmission gears.

Referring to FIG. 5, a further alternative embodiment of a portable handheld electric screwdriver 10 is shown with an even smaller upper housing height 92 than the previously mentioned alternative embodiment. The longitudinal length of the upper housing 18 remains essentially the same, but instead of four longitudinally aligned spur gears as previously discussed, six longitudinally aligned spur gears, 90A through 90F are provided. This enables the user to position the reaching portion of the handheld screwdriver 10, the reaching portion being the upper housing 18, into even narrower and smaller confined spaces.

The overall housing height 92 of the upper housing 18 is only limited to the diameter of the individual spur gears and the upper housing casing itself.

Users may find that besides utilizing the significant rotational degrees of freedom of the spindle housing, additional angles may be desired. Because the spur gears can be rotated about one another, and no loss in drive shaft power will be noticed, additional hinges or rotational shafts can be provided centered on the various intermediate spur gear shafts as desired to provide for additional arm configurations.

Figure 5A:
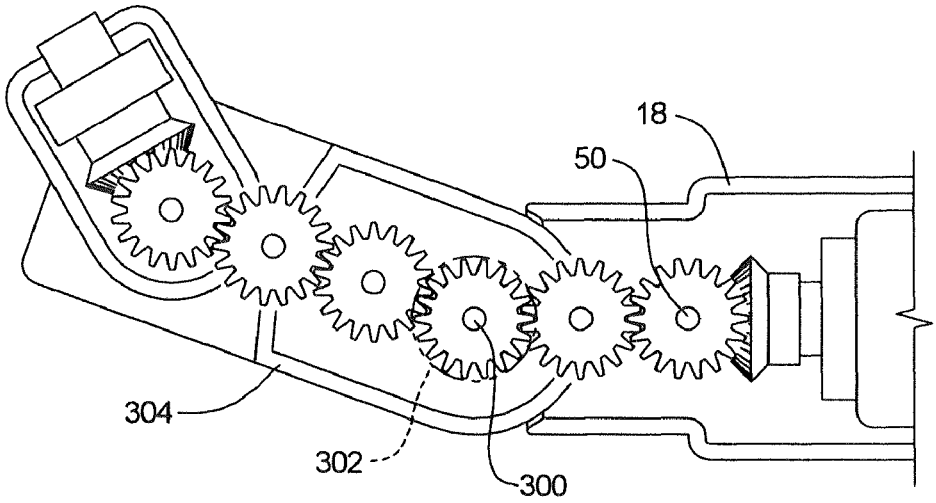
FIG. 5A is an elevation view of an alternative embodiment of the handheld electric screwdriver showing an intermediate transmission casing to provide additional rotational configurations.

Referring to FIG. 5A, one such other configuration includes providing an additional transversely aligned rotational shaft 300, which in this particular embodiment is shown centered on the longitudinally forward intermediate spur gear 302. In this particular embodiment, the transversely aligned rotational shaft 300 is essentially an extension of the spur gear support shaft 59, FIG. 2, as previously discussed in the above embodiments.

Still referring to FIG. 5A, the transversely aligned rotational shaft 300 extends transversely from one housing sidewall 51 to the other side, and is resting on ball bearings 54 embedded within the sidewall housings 51, similar to FIG. 2 as previously discussed.

Figure 5B:
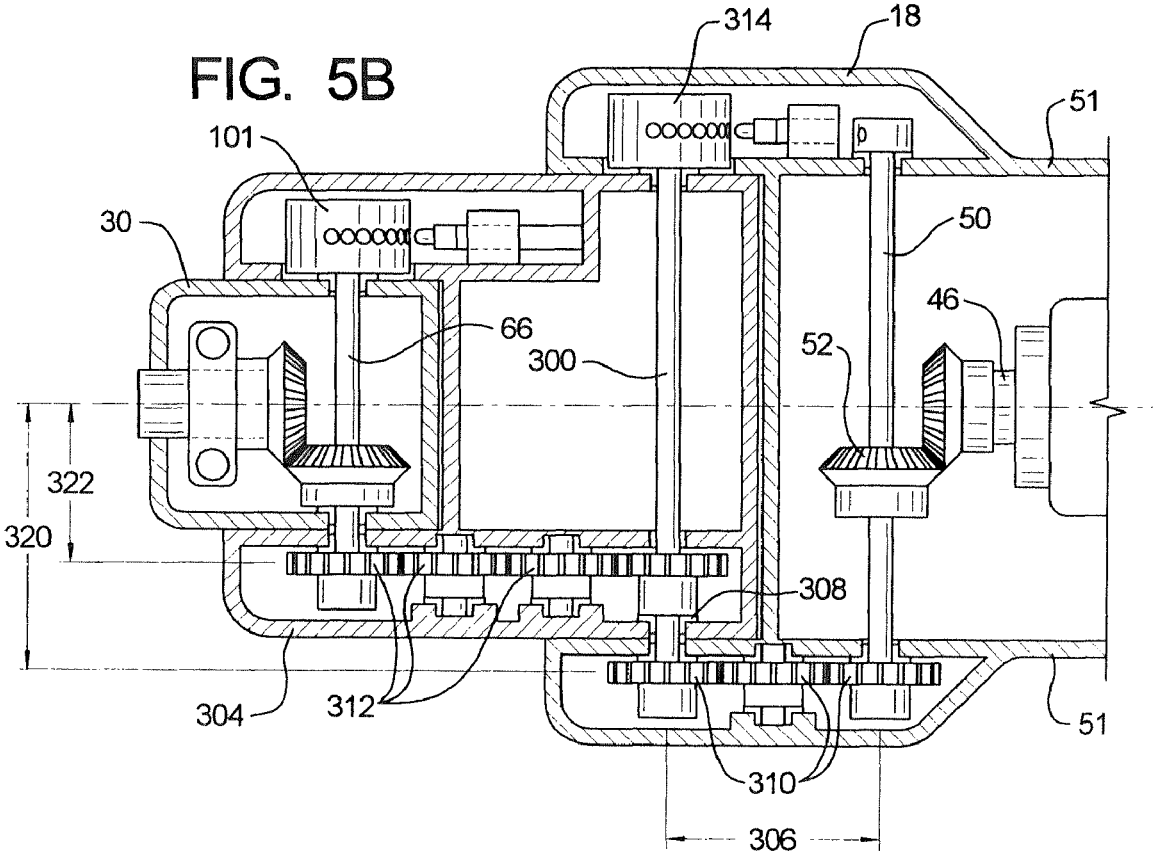
FIG. 5B is a plan view of an alternative embodiment of the handheld electric screwdriver showing an intermediate transmission casing to provide additional rotational configurations.

Still discussing the current alternative embodiment, and referring to both FIGS. 5A and 5B, the intermediate transmission casing 304 rotates around the transversely aligned rotational shaft 300, by connecting to the transversely rotational shaft 300 using ball bearings 308 enabling the intermediate transmission casing 304 to rotate independently from the rotational work being performed on the transversely aligned rotational shaft 300. The rotational work from the upper housing intermediate spur gears 310 is transmitted into the intermediate casing spur gears 312 which in turn translate the rotational work to the upper transverse drive shaft 66 as previously discussed in the aforementioned embodiments. Similar to the aforementioned embodiments, the spindle housing 30 can rotate about the upper transverse drive shaft 66 and be fixed in its desired rotational position.

As previously mentioned, the upper housing spur gears 310 are aligned in series along the longitudinal axis. These upper housing spur gears 310 are positioned off-center from the drive shaft center line 46. In the current embodiment, the upper housing spur gears 310 are positioned a transverse distance furthermost away from the drive shaft center line 46. The intermediate casing spur gears 312 are also longitudinally aligned in series and transversely offset from the drive shaft center line 46. In this particular embodiment, the intermediate casing spur gears 312 are transversely offset a lesser distance from the center line of the drive shaft 46 than the previously mentioned transverse offset distance.

As previously mentioned, the upper housing spur gears 310 are aligned in series along the longitudinal axis. These upper housing spur gears 310 are positioned a maximum transverse offset distance 320 from the drive shaft center line 46. Similarly, the intermediate casing spur gears 312 are also longitudinally aligned in series parallel with the drive shaft center line 46 but are also offset a intermediate transverse offset distance 322 which is a lesser distance than the upper housing spur gear maximum transfer offset distance 320.

The intermediate transverse casing 34 and the spindle housing 30 can be fixed in desired rotational positions through the use of the rotational locking mechanism 101 for the spindle housing 30, and the intermediate casing rotational locking mechanism 314. Similar degrees of freedom can be provided for both rotational locking mechanisms as previously discussed in the prior mentioned embodiments.

It is conceivable that additional intermediate transmission casings can be provided besides the previously described alternative embodiment. Additional intermediate transmission casings centered on additional transversely aligned rotational shafts and being provided with additional intermediate casing rotational locking mechanisms and transmissions would offer the portable electric handheld screwdriver 10 additional configurations to reach within small spaces to perform the desired work.

A detailed discussion of an alternative embodiment of the electric handheld screwdriver will now be provided. Referring to FIG. 9, an electric handheld screwdriver 200 is shown where the screwdriver is arranged along a longitudinally aligned axis 208. The alternative embodiment of the electric handheld screwdriver 200 includes the main body portion 202 and the articulating arm portion 204. The main body portion 202 holds the battery pack 206, the motor, and a planetary gear box discussed below. Interoperable with the main body is a power switch 201. The power switch 201 has a forward position and a rearward position as well as an off position. The forward position enables the user to drive the securing element or screw in a clockwise position, driving the element into say for example a board; the rearward position or reverse position enables the user to turn the securing element counterclockwise to extract the securing element from say for example a board. The articulating arm 204 is rotatable 360° about the longitudinally aligned axis 208, and includes a first transversely aligned hinge shaft 210 and a second transversely aligned hinge shaft 212. The first transversely aligned hinge shaft 210 is arranged along a first transversely aligned axis 209 and the second transversely aligned hinge shaft 212 is arranged along a second transversely aligned axis 211. The articulating arm 204 can pivot about the longitudinally aligned axis, the first and the second transversely aligned axes to provide for 3 degrees of rotational freedom of the articulating arm. A transversely aligned plane is defined by the second section or upper casing and the third section or spindle housing rotating either radially or tangentially about the origin or the first transversely aligned axis 209 which rotation defines the transversely aligned plane. A longitudinally aligned plane is defined perpendicular to this transversely aligned plane.

Figure 10:
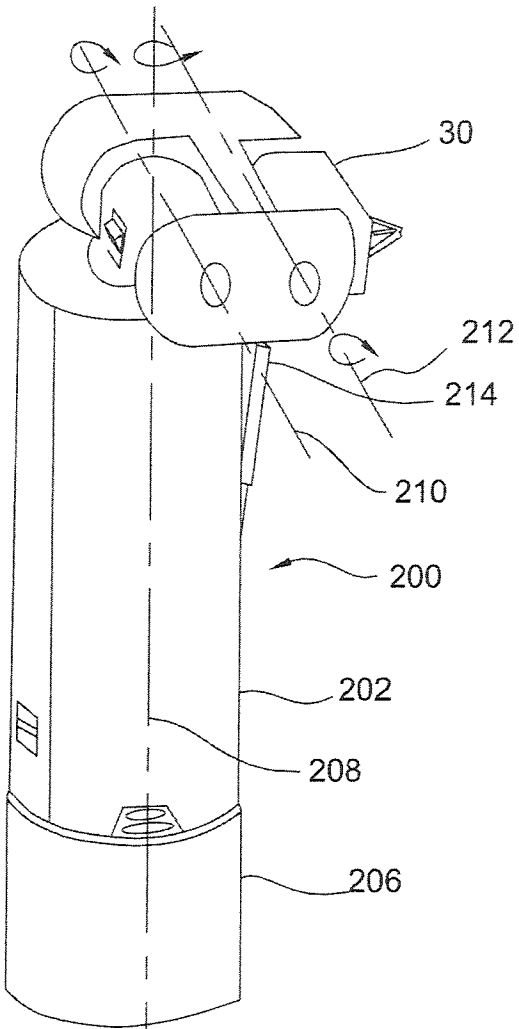
FIG. 10 is a second perspective view of an alternative embodiment of the electric handheld screwdriver.
Figure 9A:
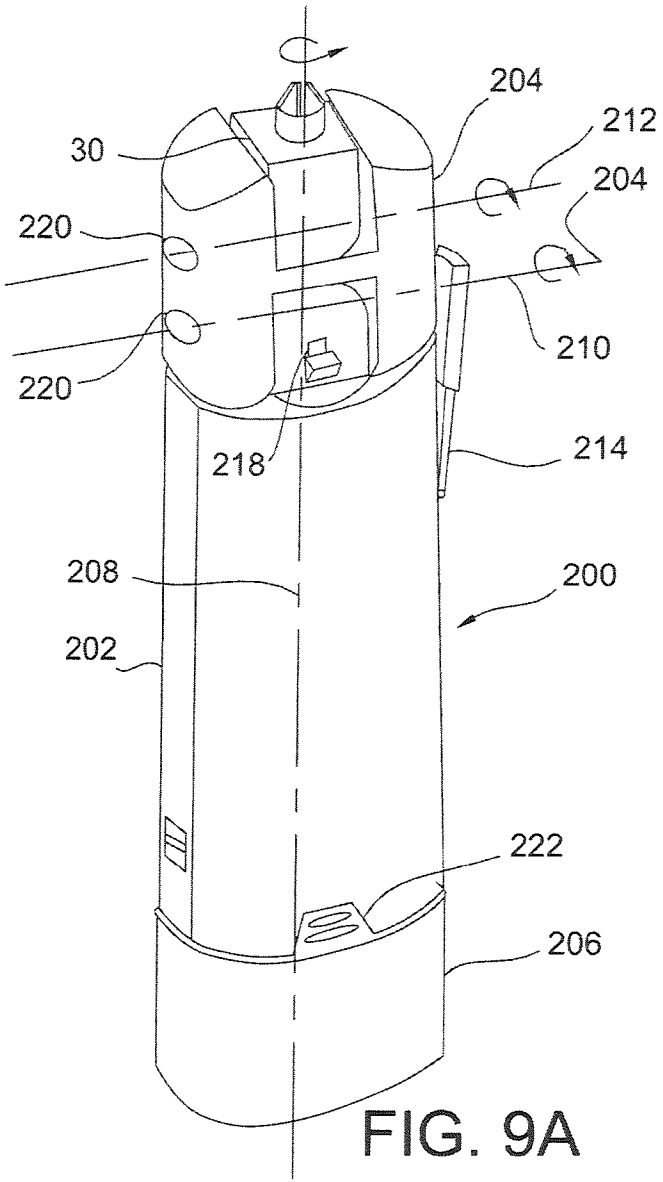
FIG. 9A is a perspective view of an alternative embodiment of the electric handheld screwdriver.

Referring to FIGS. 9 and 10, the electric handheld screwdriver 200 is shown with the articulating arm 204 rotated about the longitudinally aligned axis 208 and pivoted about the first transversely aligned axis 209 utilizing two of the 3 degrees of rotational freedom available to the articulating arm. The spindle housing 30 remains radially aligned with the first transversely aligned hinge shaft 210.

The articulating arm 204 can be locked in various positions utilizing various pushbutton lock mechanisms which will be more fully discussed below. The articulating arm 204 can be locked about the longitudinally aligned rotational axis 208 utilizing a first lock 218 as seen in FIGS. 9 and 10. The articulating arm 204 can be locked about the first transversely aligned axis 209 utilizing an integrated pushbutton lock 220; the same pushbutton lock 220 is utilized for the second transversely aligned hinge shaft 212. Each of the pushbutton locks enable the user to lock the articulating arm 204 about the first, second, and third rotational axes.

Still referring to FIGS. 9 and 10, an adjustable two-position trigger 214 is provided which enables the user to adjust the length of the trigger to accommodate various positions of the articulating arm 204. For example, the user may arrange the spindle housing 30 and align the bit head within the spindle housing 30 at a particular angle utilizing the three axial degrees of rotational freedom. The user can then rotate the main body 202 to align the two-position trigger 214 to be within the same plane as the bit head. If the trigger interferes with the articulating arm outer casing, the user can adjust it to avoid interference with the spindle housing 30 and bit head.

Figure 13:
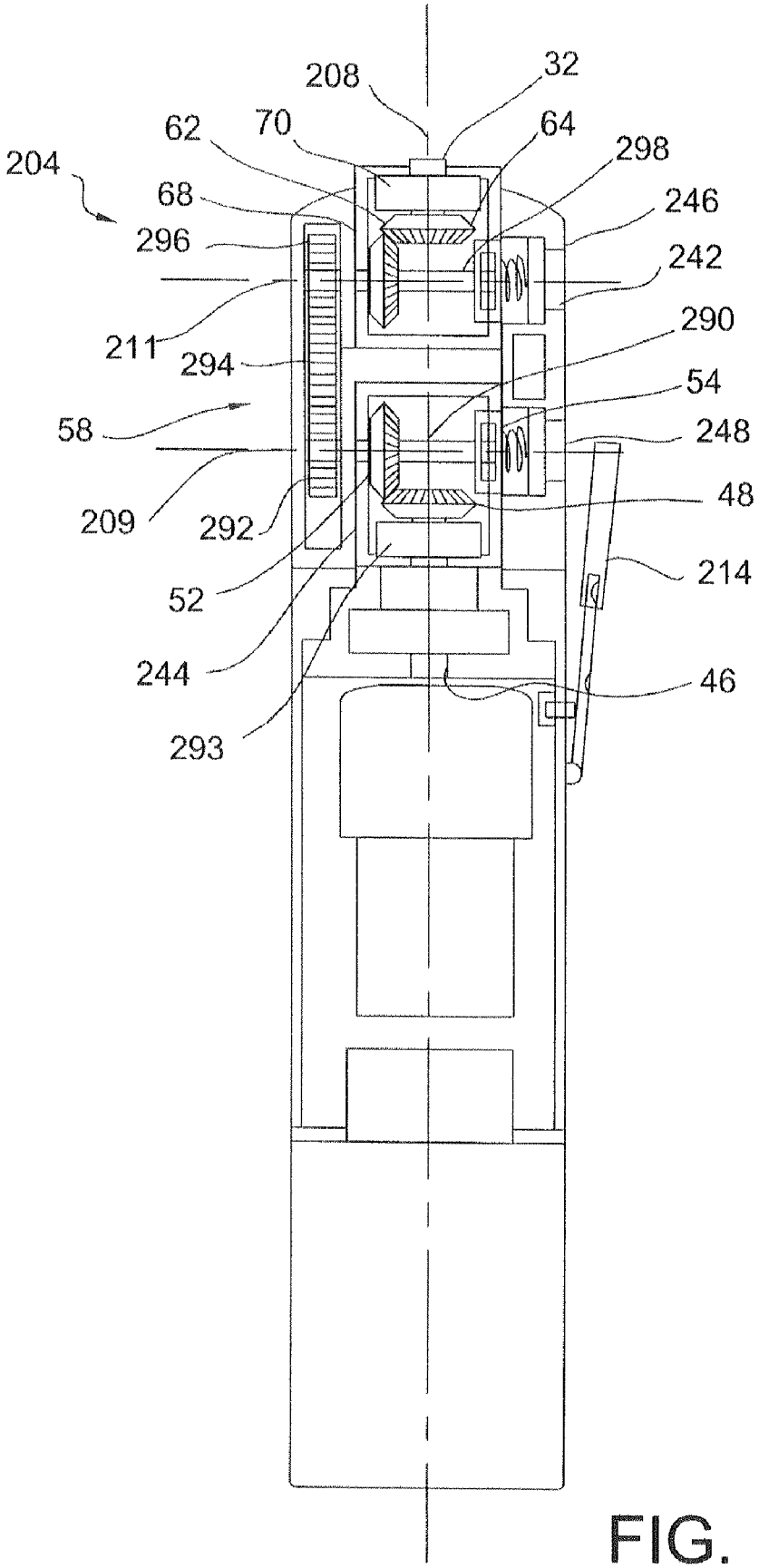
FIG. 13 is a plan detail view of an alternative embodiment of the electric handheld screwdriver.
Figure 13A:
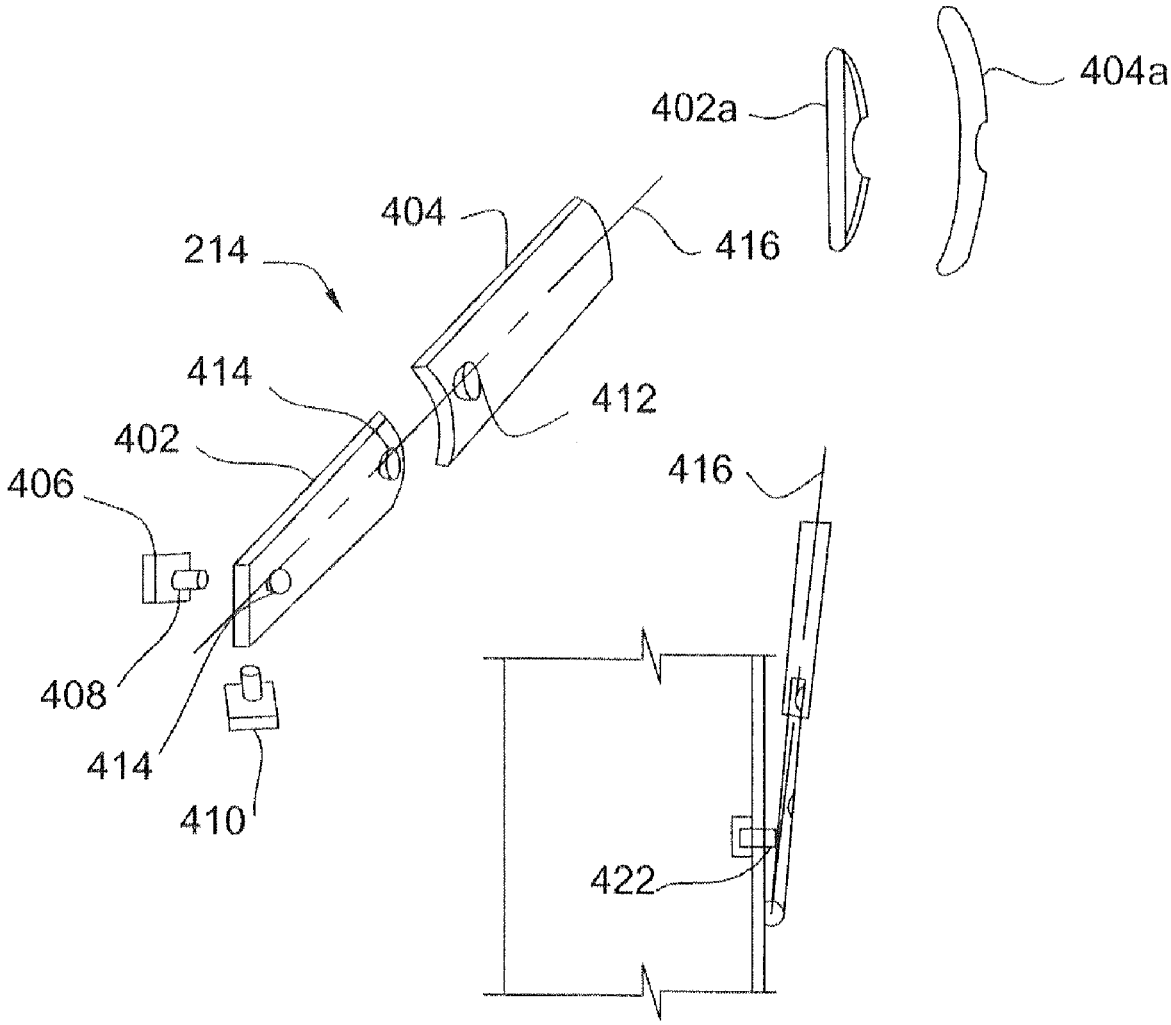
FIG. 13A is a detailed perspective view of the two-position trigger mechanism.

Referring to FIG. 13A, a brief detailed discussion of the two position squeeze trigger will now be provided. The two position squeeze trigger 214 has a first motor engaging portion 402 and a second extending portion 404. The second engaging portion 404 in this particular embodiment is slidably attached as an outer piece 404A over the first motor engaging portion or inner piece 402A. The outer piece 404A has a male bubble portion 412 which acts as an engageable insert to the upper and lower axially aligned first and second female receptors 414. The first and second trigger portions extend along a trigger axis 416.

The first motoring engaging portion of the trigger is attached to the outer face of the main body housing 12 through a hinge 410. A spring 422 acts as a resisting force to maintain the trigger 214 in its' non-motor engaging position until the user levers the squeeze trigger 214 against the plunger 408 to activate the switch 406. Once the switch is activated, the current in the drive motor is engaged and the electric screwdriver starts.

When the user requires an elongated trigger mechanism, the user can pull the extendable outer piece 404 axially outwards to extend the length of the trigger when needed during the operation. This makes for ease of use and configuration customization depending on a particular work to be performed.

Figure 11:
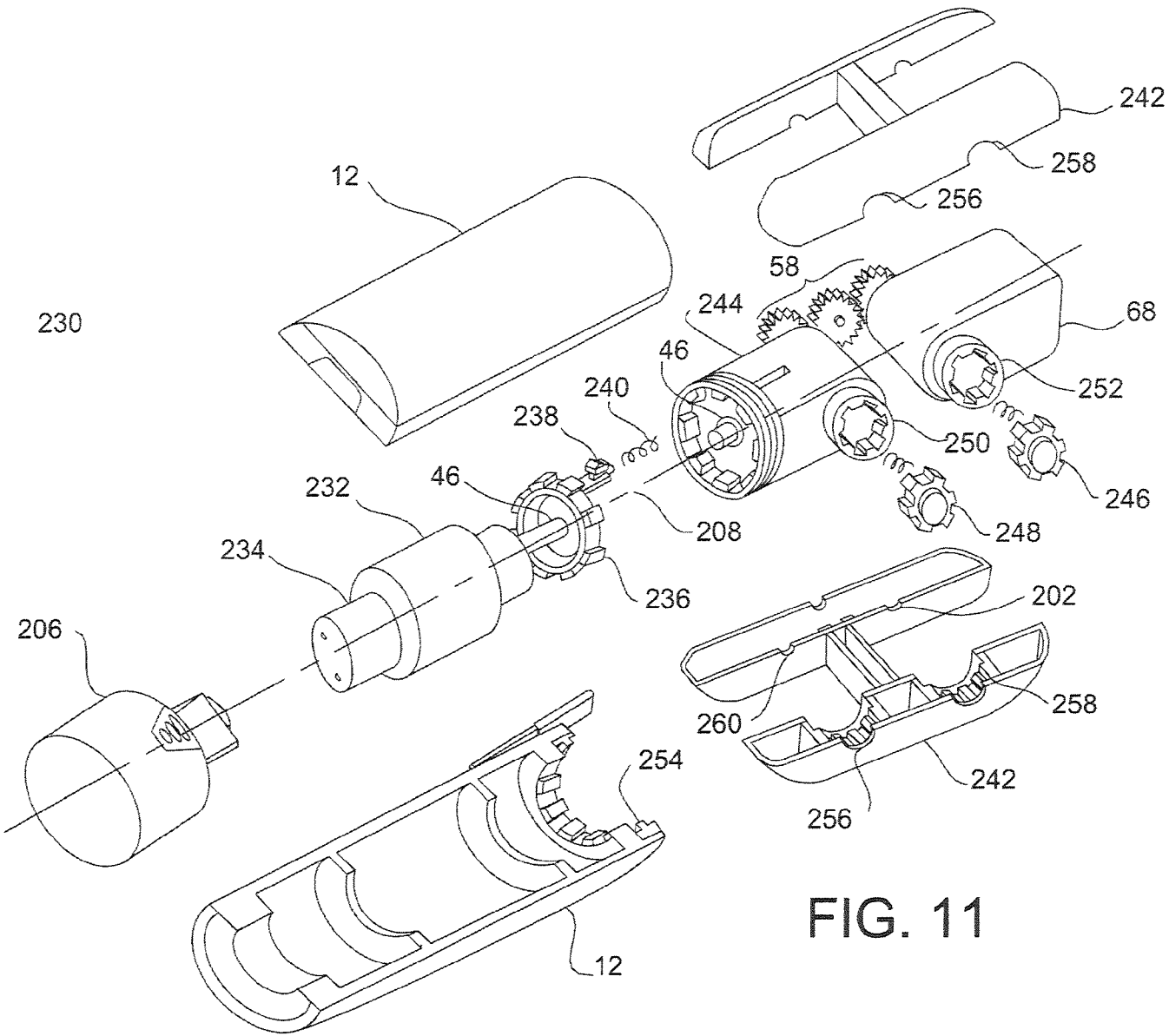
FIG. 11 is an exploded perspective view of the alternative embodiment of the electric handheld screwdriver.

Referring now to FIG. 11, a discussion of the main interior components will now be provided. The battery 206 is a removable battery pack which seats into the housing 12. The housing has an upper and lower casing. The housing of the main body 202 holds the motor 234 which is connected to the planetary gear box 232. The planetary gearbox which will be discussed further below provides for proper gear ratio to provide the needed rotational gear output for the drive shaft 46. The drive shaft itself is aligned along the longitudinally aligned central axis 208. The drive shaft extends through a rotational interlocking catch lock 236. It is this rotational interlocking catch lock which enables the user to lock and unlock the articulating arm 204 during cylindrical rotation about the longitudinally aligned axis 208.

A first section or cylindrically configured rotational midsection 244 interoperates with a rotational interlocking locking catch lock 236 and the rotational midsection 244 receives the drive shaft 46. The user can actuate by pressing upwards the rotational lock release 238 against the spring 240 which will release the rotational lock 238 from interoperation with the rotational interlocking catch lock 236. This enables the user to cylindrically rotate the rotational midsection 244 about the longitudinally aligned central axis. The rotational midsection 244 slides about the longitudinally aligned central axis while seated on a lower sliding flange 254. The rotational midsection 244 is seated with a second section or articulating arm casing 242. The articulating arm casing has a first half and a second half or upper and lower halves which connect together to seat the rotational midsection 244 as well as the spindle housing 68.

The second section or articulating arm casing 242 has a number of shaft seats or bearing seats to position and maintain seating of the midsection and spindle housing. These include an upper and lower locking ring seat 256 and 258 respectively for the rotational midsection 244 and the spindle housing 68. They also include upper and lower axle seats 260 and 262 respectively. The articulating arm casing 242 also holds a transmission or also known as the longitudinally aligned spur gears 58 and the seats for the spur gear shaft to be discussed below.

Figure 12:
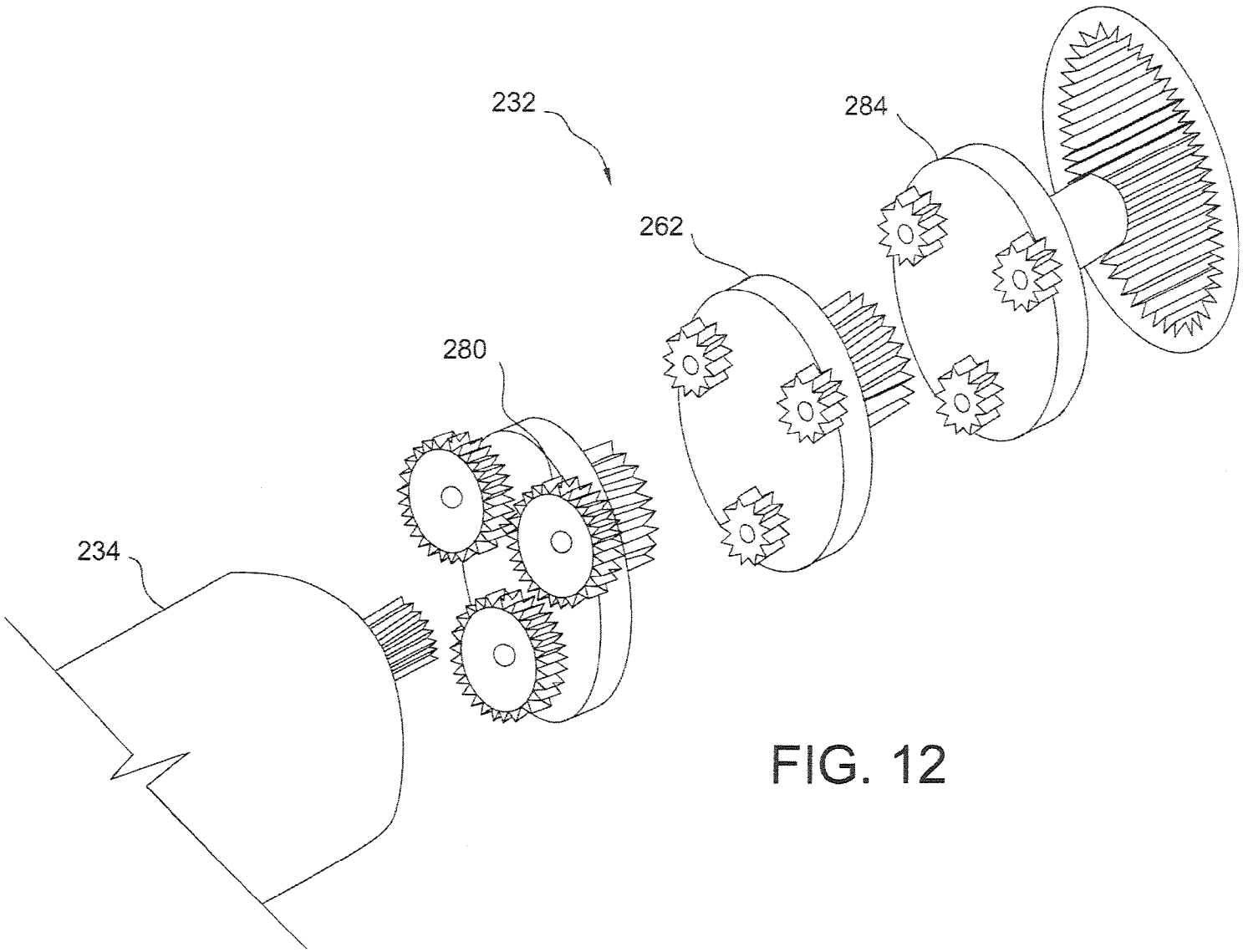
FIG. 12 is an exploded perspective detail view of a three-stage planetary gearbox.

Now referring to FIG. 12, a discussion of the planetary gearbox 232 will now be provided. To achieve the proper gear ratio output based on the smaller diameter of the existing housing 12, keeping the housing 12 to a smaller diameter close to the same diameter of the motor 234, a third stage gear ratio has been added. The planetary gear box includes a first gear ratio stage 280 which interfaces with a second gear ratio stage 282 providing for what is usually a standard gear ratio for an electric screwdriver, but because of the smaller diameter, a third gear ratio stage 284 is provided to attenuate the proper output of the electric screwdriver.

The three stage planetary gearbox diameter is maintained at essentially the same diameter as the existing electric motor. While a three-stage gear box is used, a two-stage gear box may also be utilized.

Now referring to FIG. 13, a detailed discussion of the operation of the articulating arm 204 will now be provided.

This articulating arm 204 utilizes compact positioning of the drive shafts and hinges in integrated format to allow the articulating arm to pivot about 3 degrees of rotational freedom. Each of the drive shafts discussed below also act as the rotational pivoting shaft about the particular axial degree of freedom. For example, a longitudinal axis 208 is aligned along the centerline of the drive shaft 46. The first rotational degree of freedom enables the articulating arm 204 to cylindrically rotate about this longitudinally aligned axis 208. Next, the first transversely aligned axis 209 is aligned with the first transversely aligned drive shaft 290 which also acts as the pivot point for the second rotational degree of freedom for the articulating arm. Lastly, the second transversely aligned axis 211 is the central axis of the second transversely aligned drive shaft 298, which acts as the third rotational degree of freedom for the articulating arm.

The drive shaft extends through the bottom portion of the rotational midsection housing 244 and through a midsection bearing 293 and terminates in a drive shaft miter gear 48. The drive shaft 46 actuates or rotates the drive shaft miter gear 48 which works on a first transversely aligned miter gear 52. The miter gear 52 is connected to the first transversely aligned drive shaft 290 which also acts as the pivot shaft for the articulating arm casing 242. The first transversely aligned drive shaft 290 is seated on opposing bearings maintained within the rotational midsection housing 244, which enables the arm casing 242 to articulate about the first transversely aligned drive shaft 290 and the first transversely aligned axis 209.

Figure 14:
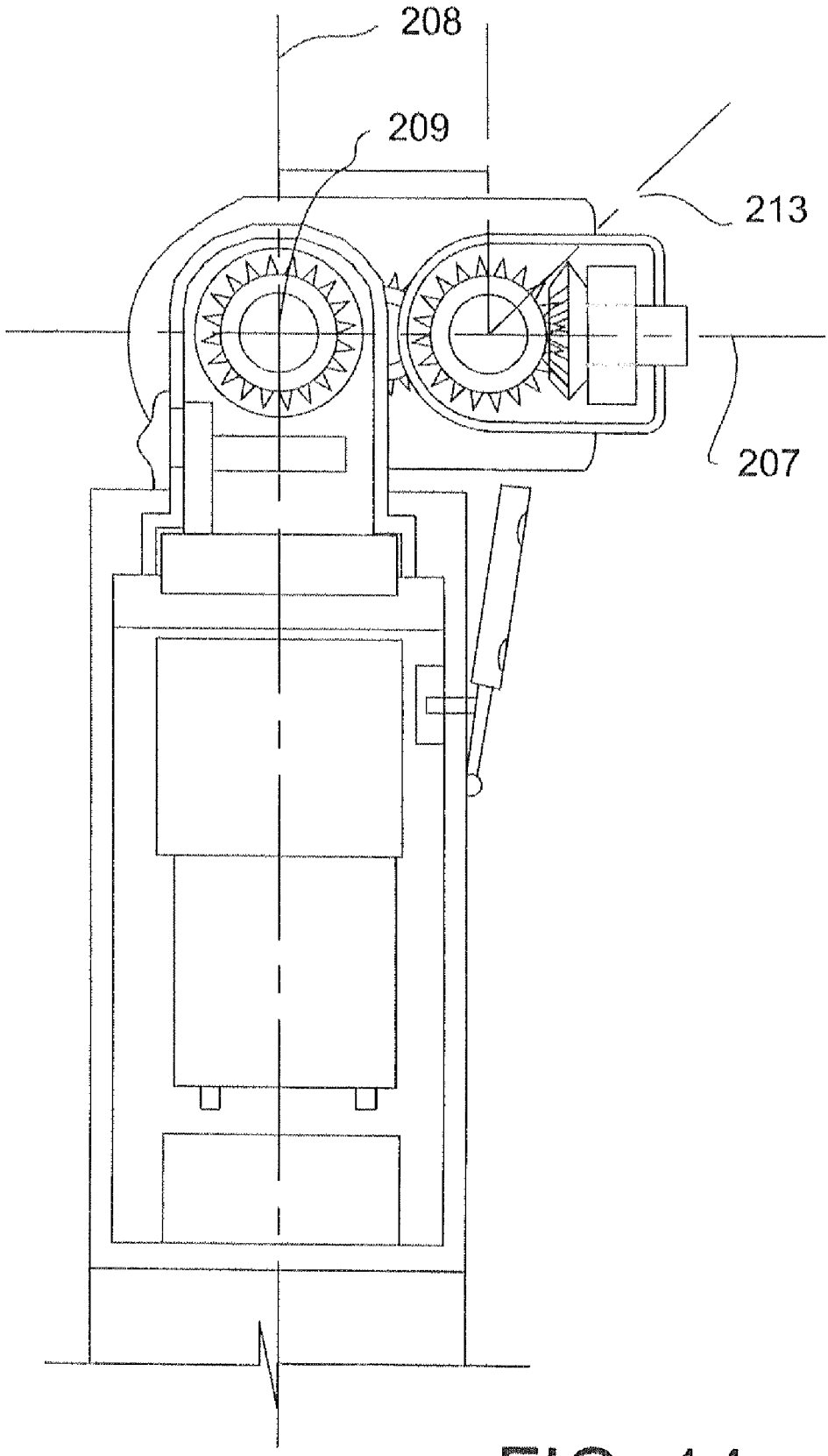
FIG. 14 is a cross-sectional elevational view of an alternative embodiment of the electric handheld screwdriver.

In addition to the second rotational degree of freedom which is provided about the first transversely aligned drive shaft 290, the drive shaft being actuated and rotated by the first transversely aligned miter gear 52 actuates a transmission which includes a first radially aligned spur gear 292 connected at one end of the first transversely aligned drive shaft 280. The transmission or spur gears 58 transmit the rotational work along a radial axis 207 as seen in FIG. 14. This radially aligned first axis 207 pivots about the center point of the first transversely aligned axis 209.

Rotational work is transferred from the first radially aligned spur gear 292 to the second radially aligned spur gear 294 which is seated on an axle maintained within the articulating arm casing 242. This intermediate or second spur gear 294 in turn rotates the third radially aligned spur gear 296 which is fixedly attached to the second transversely aligned drive shaft 298. The rotational work is transferred into the second transversely aligned miter gear 62 which interoperates with an upper spindle miter gear 64 connected to the spindle bit 32. The spindle bit 32 holds the bit which performs the work on the securing elements within the small space.

The third section or spindle housing 68 is seated on the second transversely aligned drive shaft 298 which also access the spindle housing axle. To provide for independent rotation, the spindle housing 68 is seated on bearing casings maintained in the articulating arm casing 242 enabling the spinal housing to have a range of movement with the second transversely aligned axis 211 providing for a second radially aligned axis 213 and the third rotational degree of freedom of the articulating arm 204.

Therefore I claim:

1. An apparatus to accomplish rotational work on a securing element, the apparatus comprising:

a. a main body and an articulating arm, said main body comprising a power source, a drive motor powered by said power source, said drive motor interoperating with a drive shaft, all arranged along a longitudinally aligned axis;

b. said articulating arm comprising a first housing section rotatable with respect to said main body about said longitudinally aligned axis defining a first degree of rotational freedom, said drive shaft transmitting rotational work to said first housing section;

c. said articulating arm further comprising a second housing section rotatable with respect to said first housing section about a first transversely aligned axis defining a second degree of rotational freedom, said first housing section transmitting rotational work to said second housing section;

d. said articulating arm further comprising a third housing section rotatable with respect to said second housing section about a second transversely aligned axis defining a third degree of rotational freedom, said second housing section transmitting rotational work to said third housing section, said rotational work transmitted from said second housing section to said third section and interoperating with a spindle section to accomplish rotational work on said securing element.

2. The apparatus according to claim 1 wherein said apparatus further comprises:

a. a first transversely aligned drive shaft arranged along said first transversely aligned axis, said second housing section rotatable about said first transversely aligned drive shaft within said second degree of rotational freedom, said drive shaft interoperating with said first transversely aligned drive shaft to transmit said rotational work through said second housing section.

3. The apparatus according to claim 2 wherein said apparatus further comprises:

a. said second housing section maintaining a radially aligned transmission rotatable with said second housing section about said first transversely aligned drive shaft within said second degree of rotational freedom, said first transversely aligned drive shaft interoperating with said radially aligned transmission to transmit rotational work to said third housing section.

4. The apparatus according to claim 3 wherein said apparatus further comprises:

a. said third housing section comprising a second transversely aligned drive shaft arranged along said second transversely aligned axis within said third degree of rotational freedom, said radially aligned transmission interoperating with said second transversely aligned drive shaft to transmit said rotational work through said third housing section to said spindle section interoperating with said third housing section.

5. The apparatus according to claim 4 wherein said drive shaft further comprises: a drive shaft miter gear interoperably attached to said first transversely aligned drive shaft by a transversely aligned drive shaft miter gear to transmit said rotational work.

6. The apparatus according to claim 5 wherein said first transversely aligned drive shaft further comprises: a first spur gear interoperably connected to said radially aligned transmission to transmit said rotational work.

7. The apparatus according to claim 6 wherein said radially aligned transmission further comprises: a first intermediate spur gear interoperating with said first spur gear to transmit said rotational work to a second spur gear interoperating with said second transversely aligned drive shaft.

8. The apparatus according to claim 7 wherein said second transversely aligned drive shaft further comprises a second drive shaft miter gear interoperating with a spindle miter gear interoperating with said spindle section.

9. The apparatus according to claim 8 wherein said third section further comprises a bearing seat to maintain said spindle section along a second radial axis about said second transversely aligned drive shaft and enabling said spindle section to cylindrically rotate about said second radial axis when said rotational work is transferred from said second transversely aligned drive shaft to said spindle section by said second drive shaft miter gear.

10. The apparatus according to claim 1 wherein said main body further comprises: a current polarity switch comprising a forward motor setting and a reverse motor setting.

11. The apparatus according to claim 1 wherein said first housing section further comprises:

a. a first rotational lock/release mechanism maintained on said first housing section and interoperating with said main body to interoperably lock and release said first housing section from cylindrical rotation about said longitudinally aligned axis.

12. The apparatus according to claim 11 wherein said first rotational lock/release mechanism further comprises a spring-loaded locking mechanism.

13. The apparatus according to claim 1 wherein said second housing section further comprises: a second rotational lock/release mechanism maintained on said second housing section and interoperating with said first housing section to interoperably lock and release said second housing section about said second degree of rotational freedom.

14. The apparatus according to claim 13 wherein said second rotational lock/release mechanism further comprises: a second spring-loaded lock/release mechanism.

15. The apparatus according to claim 1 wherein said third housing section further comprises: a third rotational lock/release mechanism maintained on said third section and interoperating with said second housing section to operably lock and release said third housing section about said third degree of rotational freedom.

16. The apparatus according to claim 15 wherein said third rotational locking release mechanism further comprises: a third spring-loaded lock/release mechanism.

17. The apparatus according to claim 1 wherein said apparatus further comprises:

a. a two-position squeeze trigger mechanism arranged on said main body.

18. The apparatus according to claim 17 wherein said two-position squeeze trigger mechanism further comprises a first motor engaging portion and a second extending portion, said first motor engaging portion interoperating with said drive motor to engage and disengage said drive motor, said second extension portion arranged to extend and retract in axial alignment with said first motor engaging portion to accommodate orientation of said articulating arm.

19. The apparatus according to claim 17 wherein said apparatus further comprises:

a. said second section and said third housing section interoperating within a transversely aligned plane having a transverse plane origin at said first transversely aligned axis, said main body cylindrically rotatable about said longitudinally aligned axis enabling said two-position squeeze trigger mechanism to be rotatably positioned within a longitudinally aligned plane maintained substantially perpendicular to said transversely aligned plane, said longitudinally aligned plane having a longitudinal plane origin at said longitudinally aligned axis.

20. The apparatus according to claim 19 wherein said apparatus further comprises:

a. said two-position squeeze trigger mechanism configured to be arranged substantially within said transversely aligned plane.

21. The apparatus according to claim 1 wherein said drive motor further comprises: a two-stage planetary gear box.

22. The apparatus according to claim 1 wherein said drive motor further comprises: a three-stage planetary gear box.

23. The apparatus according to claim 1 wherein said main body further comprises a power switch.

24. The apparatus according to claim 1 wherein said first housing section rotatable about said longitudinally aligned axis defining said first-degree of rotational freedom further comprises: 360 degrees of rotational freedom.

25. The apparatus according to claim 1 wherein said second housing section rotatable about said first transversely aligned axis defining said second degree of rotational freedom further comprises: at least about 180 degrees of rotational freedom.

26. The apparatus according to claim 1 wherein said third housing section rotatable about said second transversely aligned axis defining said third degree of rotational freedom further comprises: at least about 210 degrees of rotational freedom.

27. An apparatus to accomplish rotational work on a securing element, said apparatus comprising:

a. a main body and an articulating arm, said main body comprising a power source, a drive motor powered by said power source, said drive motor comprising a three-stage planetary gearbox and interoperating with a drive shaft, all arranged along a longitudinally aligned axis;

b. said articulating arm comprising a first section rotatable about said drive shaft and defining a first-degree of rotational freedom comprising 360 degrees of rotational freedom, said drive shaft further comprising a drive shaft miter gear interoperating with a first transversely aligned drive shaft through a transversely aligned drive shaft miter gear;

c. said articulating arm further comprising a second section rotatable about said first transversely aligned drive shaft and defining a second degree of rotational freedom comprising at least about 180 degrees of rotational freedom, said first transversely aligned drive shaft interoperating with a radially aligned transmission arranged to rotate within said second degree of rotational freedom along with said second section;

d. said radially aligned transmission comprising a first spur gear interoperating with said first transversely aligned drive shaft, a second spur gear interoperating with a second transversely aligned drive shaft, a first intermediate spur gear interoperating with said first spur gear and said second spur gear;

e. said articulating arm further comprising a third section rotatable about said second transversely aligned drive shaft and defining a third degree of rotational freedom comprising at least about 210 degrees of rotational freedom, said second transversely aligned drive shaft comprising a second transversely aligned miter gear interoperating with a spindle section to accomplish rotational work on said securing element.

28. An apparatus to accomplish rotational work on a securing element, said apparatus comprising:

a. a main body and an articulating arm, said main body comprising means for providing rotational work to a longitudinally aligned drive shaft;

b. means for rotating a first section about said longitudinally aligned drive shaft defining a first degree of rotational freedom;

c. means for transmitting said rotational work to a second section rotatable about a first transversely aligned drive shaft defining a second degree of rotational freedom;

d. means for transmitting said rotational work to a third section rotatable about a second transversely aligned drive shaft defining a third degree of rotational freedom;

e. means for transmitting said rotational work from said third section to a spindle section to accomplish rotational work on said securing element.

* * * * *